US009854366B2

(12) United States Patent
Sakane

(10) Patent No.: US 9,854,366 B2
(45) Date of Patent: Dec. 26, 2017

(54) SPEAKER DEVICE

(71) Applicant: CLARION CO., LTD., Saitama (JP)

(72) Inventor: Keita Sakane, Saitama (JP)

(73) Assignee: CLARION CO., LTD., Saitama-Shi, Saitama (JP)

( * ) Notice: Subject to any disclaimer, the term of this patent is extended or adjusted under 35 U.S.C. 154(b) by 0 days.

(21) Appl. No.: 15/308,669

(22) PCT Filed: Jul. 1, 2015

(86) PCT No.: PCT/JP2015/068952

§ 371 (c)(1),
(2) Date: Nov. 3, 2016

(87) PCT Pub. No.: WO2016/002830

PCT Pub. Date: Jan. 7, 2016

(65) Prior Publication Data

US 2017/0150274 A1 May 25, 2017

(30) Foreign Application Priority Data

Jul. 2, 2014 (JP) ..... 2014-136653

(51) Int. Cl.
*G10K 11/16* (2006.01)
*H04R 9/06* (2006.01)
(Continued)

(52) U.S. Cl.
CPC ..... *H04R 9/063* (2013.01); *G10K 11/178* (2013.01); *H04R 7/04* (2013.01); *H04R 9/025* (2013.01);
(Continued)

(58) Field of Classification Search
CPC ..... H04R 2410/05; H04R 2499/11; H04R 25/554; H04R 3/005; H04R 2460/01;
(Continued)

(56) References Cited

U.S. PATENT DOCUMENTS

2008/0317255 A1* 12/2008 Cozens ..... H04R 9/10 381/71.6
2009/0208025 A1* 8/2009 Hayashi ..... B60R 11/0223 381/71.4

FOREIGN PATENT DOCUMENTS

JP 63-102597 * 5/1988 ..... H04R 9/04
JP 3003344 U 10/1994
(Continued)

OTHER PUBLICATIONS

International Preliminary Report on Patentability issued for corresponding PCT/JP2015/068952.
(Continued)

*Primary Examiner* — Lun-See Lao
(74) *Attorney, Agent, or Firm* — IP Business Solutions, LLC

(57) ABSTRACT

Provided is a speaker device configured so that a time lag between a sound signal and a noise cancellation signal can be prevented, worsening of high-frequency characteristics can be avoided, and acoustic characteristics can be improved. A plane diaphragm 11 includes a flexible circuit board 20. A sound voice coil pattern 21 to which drive current corresponding to a sound signal is supplied and a noise cancellation voice coil pattern 22 to which drive current corresponding to a noise cancellation signal is supplied are formed on the flexible circuit board 20 and are formed corresponding to a formed magnetic field of a magnet 13.

4 Claims, 9 Drawing Sheets

(51) Int. Cl.

| | |
|---|---|
| ***H04R 7/04*** | (2006.01) |
| ***H04R 9/02*** | (2006.01) |
| ***H04R 9/04*** | (2006.01) |
| ***G10K 11/178*** | (2006.01) |

(52) U.S. Cl.
CPC ..... *H04R 9/046* (2013.01); *G10K 2210/3044* (2013.01); *H04R 2207/00* (2013.01)

(58) Field of Classification Search
CPC .... H04R 25/50; H04R 25/505; H04R 1/1083; H04R 3/04; H04R 3/002; H04R 9/025; H04R 9/06; H04R 1/04; H04R 1/1091; H04R 2400/00; H04R 2499/13; G10K 11/178; G10K 11/1788; G10K 2210/3212; G10K 11/16; G10K 11/002; G10K 11/175; G10K 13/00; G10K 2210/104; G10K 2210/1081
USPC ..... 381/71.1–71.7, 94.1–94.4, 150, 386, 182
See application file for complete search history.

(56) References Cited

FOREIGN PATENT DOCUMENTS

| | | | | | |
|---|---|---|---|---|---|
| JP | 10-290492 | | * | 10/1998 | ..... H04H 3/00 |
| JP | 2008-032767 | A | | 2/2008 | |
| JP | 2008-098988 | A | | 4/2008 | |
| JP | 2010-124045 | A | | 6/2010 | |
| JP | 2011-151599 | A | | 8/2011 | |
| WO | 2014/027467 | A1 | | 2/2014 | |
| WO | WO2014027467 | | * | 2/2014 | ..... H04R 3/00 |

OTHER PUBLICATIONS

Written Opinion of the International Searching Authority issued for corresponding PCT/JP2015/068952.
International Search Report issued for corresponding PCT/JP2015/068952 application.
Written Opinion of the International Search Authority issued for corresponding PCT/JP2015/068952 application.

* cited by examiner

SPEAKER DEVICE

TECHNICAL FIELD

The present invention relates to a speaker device.

BACKGROUND ART

A noise cancellation technique of cancelling external noise at, e.g., a speaker device or headphones so that a user's ears can hear only musical sound has been typically in widespread use. According to such a noise cancellation technique, the external noise is detected by a microphone, and then, a noise cancellation signal with a phase opposite to that of the detected noise signal is generated. Subsequently, the noise cancellation signal is output from, e.g., the speaker device to cancel the external noise.

Meanwhile, a full digital speaker device configured so that a digital signal can be directly input to a speaker has been recently developed. This full digital speaker device can directly transfer the digital signal to the speaker, and therefore, digital/analog conversion is no longer required. Thus, high-quality sound can be realized regardless of performance of a digital/analog converter.

However, when the above-described noise cancellation technique is applied to the full digital speaker device, a delay of about 0.5 msec to 3 msec is, due to a delay caused by an arithmetic circuit of a digital filter portion provided in the full digital speaker device, caused after input of a noise signal until output of sound.

For this reason, when an attempt is made to perform signal processing for the input noise signal to remove noise as in the typical noise cancellation technique, a noise-processed signal delay corresponding to the signal processing is also caused, and a delay in response to actual noise is caused. Thus, there is a problem that effective noise reduction cannot be performed.

In order to prevent such a delay, a device has been typically proposed, which includes a speaker unit having a single diaphragm and two voice coils configured to drive the diaphragm and which is configured such that a musical sound signal is input to one of the voice coils and a noise cancellation signal based on a noise signal detected by a noise detection microphone is input to the other voice coil, for example (see Patent Literature 1).

CITATION LIST

Patent Literature

Patent Literature 1: Japanese Patent Laid-Open No. 2008-098988

SUMMARY OF INVENTION

Technical Problem

According to Patent Literature 1, the noise cancellation signal is input to one of the double wound voice coils, and in this manner, the single diaphragm is driven to cancel noise. Thus, the signal for noise cancellation can be simplified, and a delay in response to actual noise can be reduced as much as possible.

However, the device of Patent Literature 1 is applied to a typical dynamic speaker. Due to an increase in the number of voice coils, the weights of the diaphragm and the voice coil portion themselves in the speaker device increase. For this reason, vibration of the diaphragm is reduced, leading to interruption of high-frequency characteristics and lowering of acoustic characteristics.

The present invention has been made in view of the above-described points, and is intended to provide a speaker device configured so that a time lag between a sound signal and a noise cancellation signal can be prevented, worsening of high-frequency characteristics can be avoided, and acoustic characteristics can be improved.

Solution to Problem

In order to accomplish the above-described objective, the present invention relates to a speaker device including a plane diaphragm. In the speaker device, the plane diaphragm includes a sound voice coil pattern to which drive current corresponding to a sound signal is supplied, and a noise cancellation voice coil pattern to which drive current corresponding to a noise cancellation signal is supplied, and the sound voice coil pattern and the noise cancellation voice coil pattern are formed corresponding to a formed magnetic field of a magnet.

Moreover, in the above-described configuration, the plane diaphragm may be configured such that the sound voice coil pattern and the noise cancellation voice coil pattern are formed on a flexible circuit board. Further, in the above-described configuration, the noise cancellation voice coil pattern may be formed on one side of the sound voice coil pattern. In addition, in the above-described configuration, the noise cancellation voice coil pattern may be formed on each side of the sound voice coil pattern.

Moreover, in the above-described configuration, the noise cancellation voice coil pattern may include a plurality of noise cancellation voice coil patterns, and end portions of the noise cancellation voice coil patterns may be electrically connected together to form a single noise cancellation voice coil pattern. Further, in the above-described configuration, a resistor element may be connected to a middle portion of the noise cancellation voice coil pattern. In addition, in the above-described configuration, a reinforcement pattern may be formed between two adjacent patterns of the sound voice coil pattern and/or the noise cancellation voice coil pattern of the plane diaphragm.

Advantageous Effects of Invention

According to the present invention, the sound voice coil pattern to which the drive current corresponding to the sound signal is supplied and the noise cancellation voice coil pattern to which the drive current corresponding to the noise cancellation signal is supplied are formed, and therefore, reproduced sound with a favorable sound quality can be obtained without noise signal influence on the sound signal. Moreover, since the sound voice coil pattern and the noise cancellation voice coil pattern are formed, the surface of the diaphragm can be hardened. As a result, a transmission speed by the diaphragm can be increased, and worsening of high-frequency characteristics can be avoided.

DESCRIPTION OF EMBODIMENTS

Embodiments of a speaker device of the present invention will be described below with reference to drawings.

Figure 1:
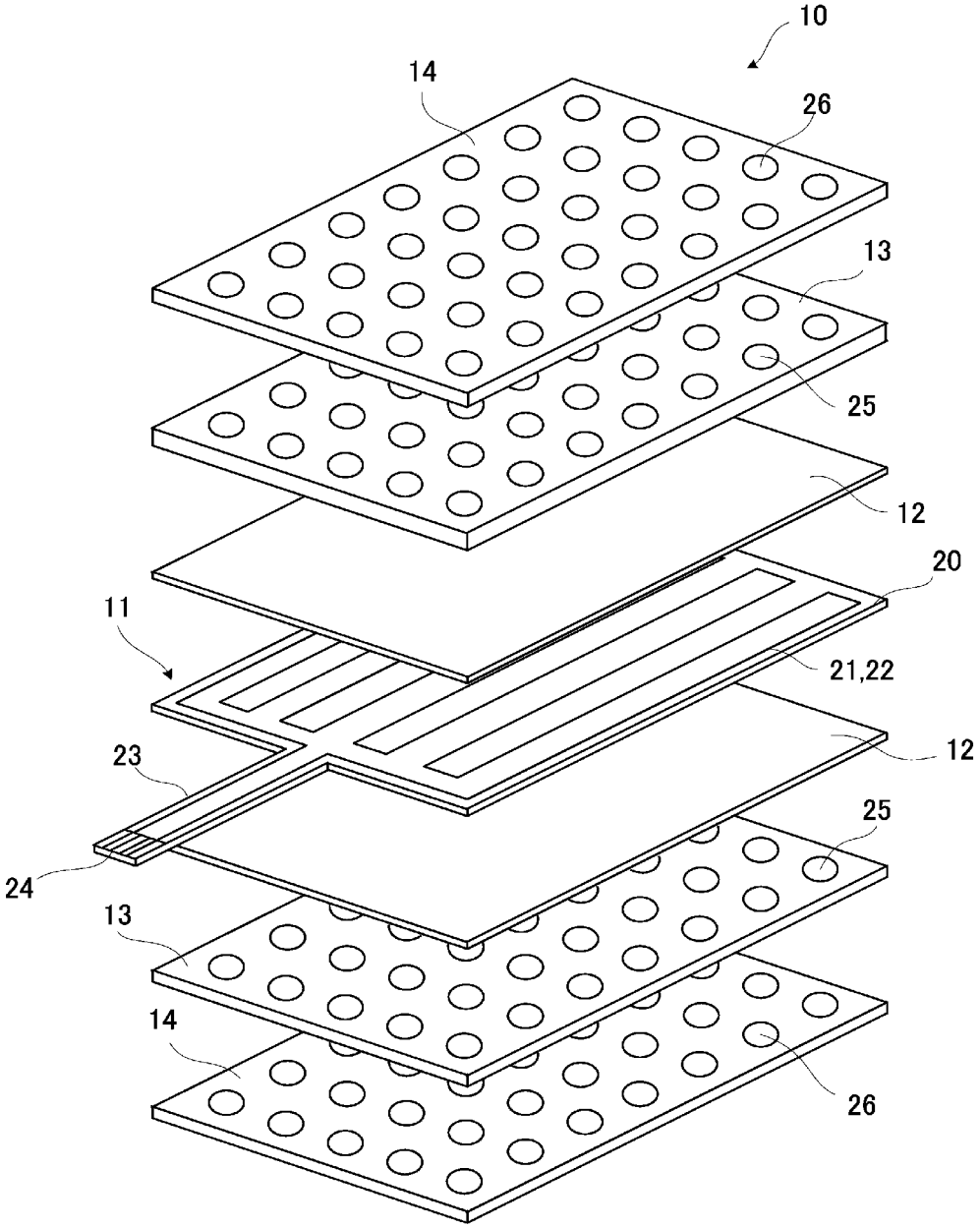
FIG. 1 is an exploded perspective view of a speaker device, illustrating a first embodiment of a speaker device of the present invention.
Figure 2:
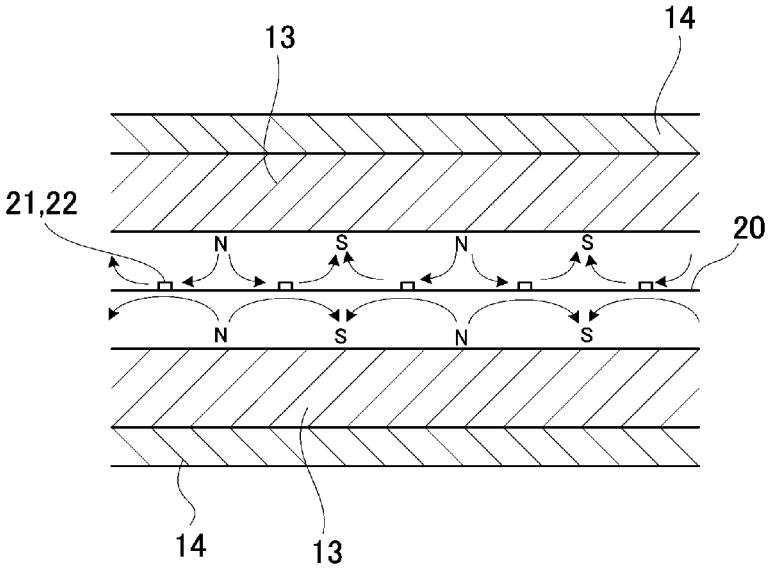
FIG. 2 is a longitudinal sectional view of the speaker device.
Figure 3:
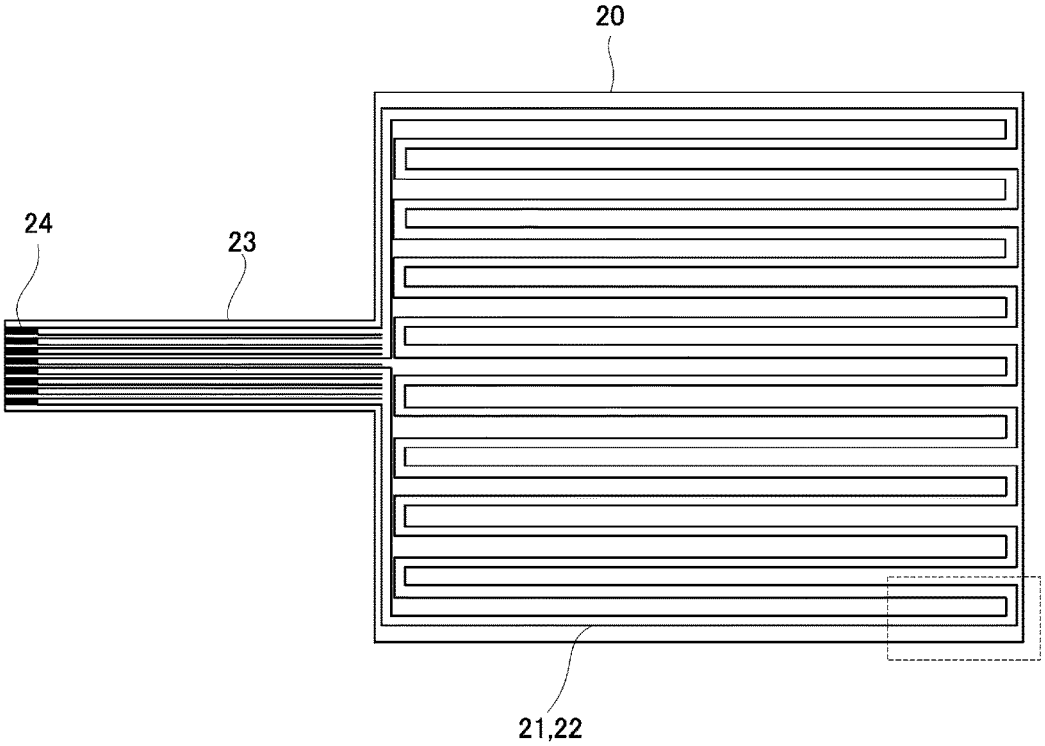
FIG. 3 is a plan view of a diaphragm.
Figure 4:
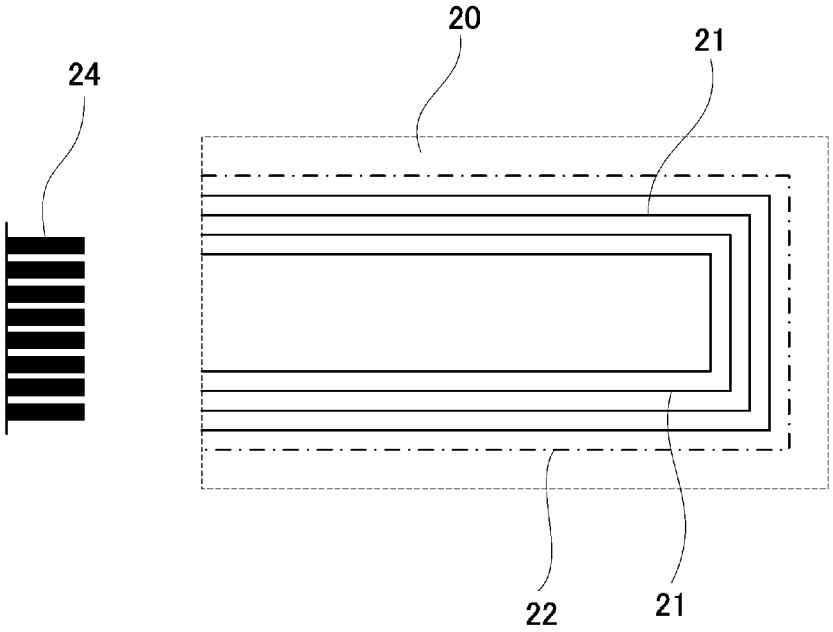
FIG. 4 is an enlarged partial view of the diaphragm in a frame indicated by a chain line of FIG. 3.

FIG. 1 is an exploded perspective view of the speaker device, and FIG. 2 is a longitudinal sectional view of the speaker device. FIG. 3 is a plan view of a diaphragm, and FIG. 4 is an enlarged partial view of the diaphragm in a frame indicated by a chain line of FIG. 3.

In the present embodiment, an example of a full digital speaker device using a plane diaphragm is described as the speaker device.

A speaker device 10 of the present embodiment includes a diaphragm 11, a pair of magnets 13 vertically sandwiching the diaphragm 11 with a buffer member 12 being interposed between each magnet 13 and the diaphragm 11, and a pair of holding members 14 covering all of these members from upper and lower sides.

The diaphragm 11 is formed of a thin film-shaped flexible circuit board 20, and a sound voice coil pattern 21 to which drive current is supplied based on a sound signal is formed on one surface of the flexible circuit board 20. As illustrated in FIGS. 3 and 4, the sound voice coil pattern 21 is formed such that a plurality of conductive wire patterns meander across the entirety of the flexible circuit board 20.

Moreover, in the present embodiment, a single noise cancellation voice coil pattern 22 is, on one side of the sound voice coil pattern 21 on the flexible circuit board 20, formed to meander substantially in parallel to the sound voice coil pattern 21, as illustrated in FIG. 3.

Figure 6:
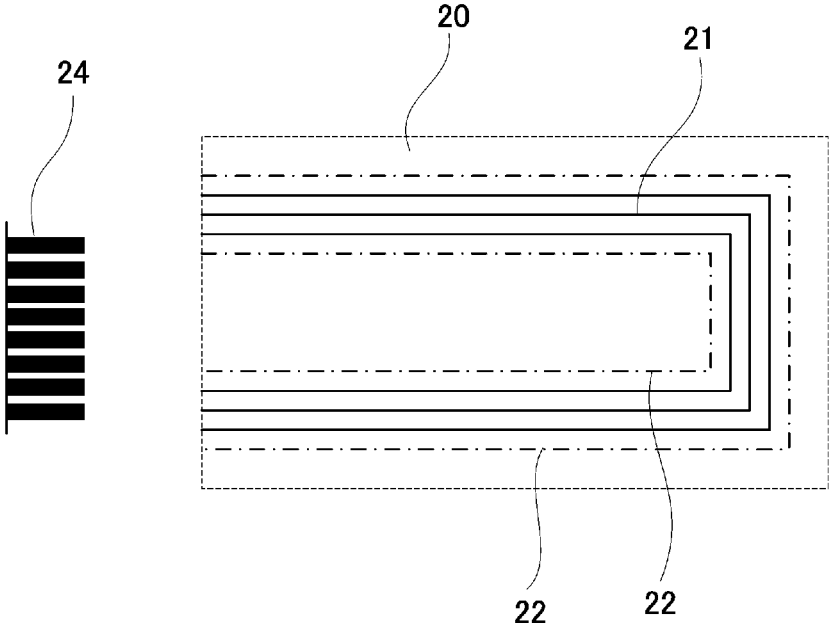
FIG. 6 is an enlarged partial view of a diaphragm, illustrating a second embodiment of the speaker device of the present invention.
Figure 9:
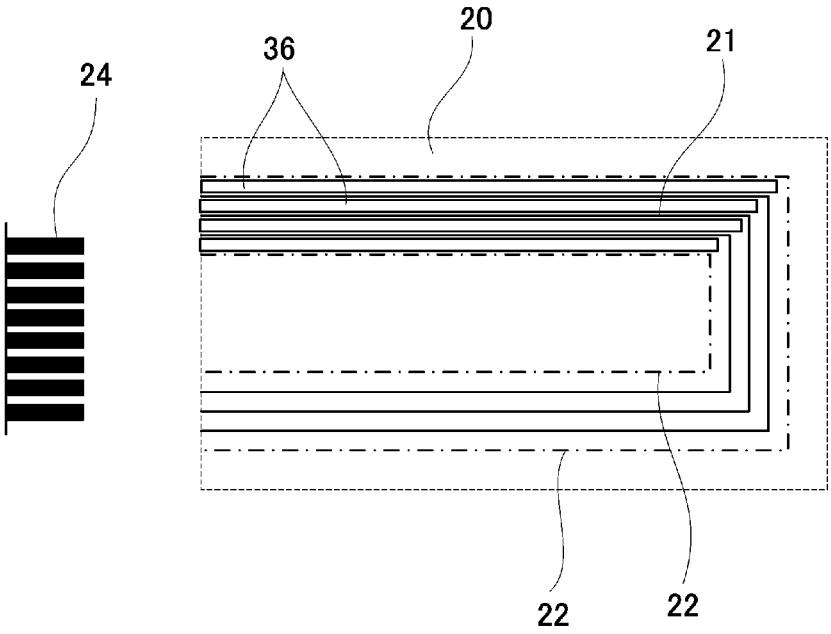
FIG. 9 is an enlarged partial view of a diaphragm, illustrating a fifth embodiment of the speaker device of the present invention.

Note that in FIGS. 4, 6, and 9, the sound voice coil pattern 21 is indicated by a solid line, and the noise cancellation voice coil pattern 22 is indicated by a chain line, for the sake of description.

A conductive wire drawing portion 23 configured to draw the sound voice coil pattern 21 and the noise cancellation voice coil pattern 22 to the outside is provided integrally with one side of the diaphragm 11, and a tip end portion of the conductive wire drawing portion 23 is provided with a terminal portion 24 connected to end portions of the sound voice coil pattern 21 and the noise cancellation voice coil pattern 22.

It is configured such that drive current is applied from the terminal portion 24 based on a predetermined digital sound signal and a predetermined analog noise cancellation signal.

Moreover, as illustrated in FIG. 2, the magnets 13 are formed in such a striped pattern that the N-pole and the S-pole are alternatively positioned along the line of the voice coil pattern.

A magnetic field component vertical to the surface of each magnet 13 is greatest in the vicinity of the N-pole and the S-pole, and is smallest in the vicinity of the boundary between the N-pole and the S-pole. On the other hand, a horizontal magnetic field component parallel to the surface of each magnet 13 is smallest in the vicinity of the N-pole and the S-pole, and is greatest in the vicinity of the boundary between the N-pole and the S-pole. Thus, a magnetic field component contributing to vibration of the diaphragm 11 in the thickness direction thereof is not a vertical component but a horizontal component (the Fleming's left hand rule).

Thus, linear portions of the sound voice coil pattern 21 and the noise cancellation voice coil pattern 22 are arranged at positions corresponding to the vicinity of the boundary between the N-pole and the S-pole such that lines of magnetic force extend in the direction intersecting the linear portions of the sound voice coil pattern 21 and the noise cancellation voice coil pattern 22 in the plane of the diaphragm 11.

Thus, in the present embodiment, it is configured such that the sound voice coil pattern 21 and the noise cancellation voice coil pattern 22 are arranged at the boundary between the N-pole and the S-pole. When drive current is applied to the sound voice coil pattern 21 and the noise cancellation voice coil pattern 22, electromagnetic force is most efficiently generated by interaction between the drive current and a magnetic field, and the diaphragm 11 vibrates in the thickness direction thereof.

As illustrated in FIG. 1, each magnet 13 is provided with a plurality of through-holes 25 through which sound output from the diaphragm 11 passes. As described above, the sound voice coil pattern 21 and the noise cancellation voice coil pattern 22 are arranged at the boundary between the N-pole and the S-pole so that the diaphragm 11 can efficiently vibrates at such a boundary. Thus, each through-hole 25 is preferably formed at a position corresponding to the boundary between the N-pole and the S-pole.

Each buffer member 12 is made of a soft material, and has a function to allow sound to pass through the buffer member 12. The buffer member 12 is made of non-woven fabric, for example. The buffer member 12 is formed to have the substantially same size as that of the diaphragm 11, and forms a predetermined gap between the diaphragm 11 and the magnet 13. The buffer member 12 is configured to prevent noise generation due to contact between the diaphragm 11 and the magnet 13 in driving of the diaphragm 11. Depending on the thickness and material of the buffer member 12, a plurality of buffer members 12 may be used in the form of a stack, if necessary.

Each holding member 14 is made of a hard material such as metal. In the state in which the diaphragm 11, the buffer members 12, and the magnets 13 are sandwiched between the holding members 14, not-shown screws etc. are screwed into the outer periphery of each holding member 14, and therefore, the diaphragm 11 is held and fixed between the pair of magnets 13 with a predetermined gap being formed between the diaphragm 11 and each magnet 13. Moreover, the holding member 14 is provided with through-holes 26 at positions similar to those of the through-holes 25 of the magnet 13, and each through-hole 26 allows sound from the diaphragm 11 to be efficiently emitted to the outside.

Next, a drive circuit of the speaker device 10 described above will be described with reference to FIG. 5.

Figure 5:
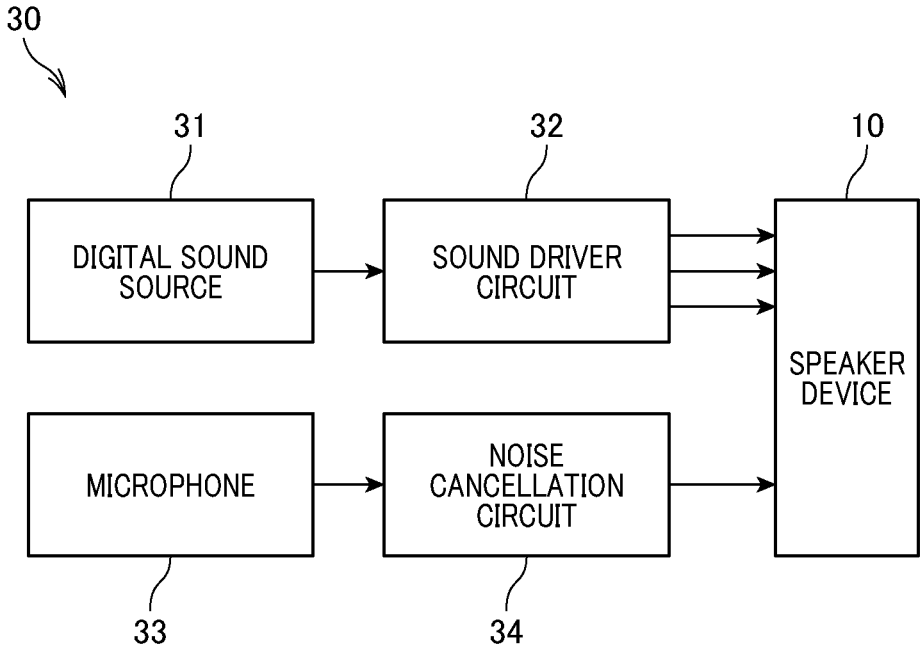
FIG. 5 is a block diagram of a drive circuit.

As illustrated in FIG. 5, a drive circuit 30 includes a sound driver circuit 32 to which a digital sound signal is input from a predetermined digital sound source 31. The sound driver circuit 32 is configured to convert the digital sound signal into a predetermined sound drive signal to supply the sound voice coil pattern 21 with drive current corresponding to the sound drive signal through the terminal portion 24.

The drive circuit 30 further includes a microphone 33 to which external noise is input, and a noise cancellation circuit 34 to which an external noise signal is input from the microphone 33. The noise cancellation circuit 34 is configured to invert the phase of the noise signal from the microphone 33 and to use the phase-inverted signal as a noise cancellation signal to supply the noise cancellation voice coil pattern 22 with drive current corresponding to the noise cancellation signal through the terminal portion 24.

Next, features of the present embodiment will be described.

In the present embodiment, the sound signal sent from the predetermined digital sound source 31 is converted into the sound drive signal by the sound driver circuit 32, and the drive current corresponding to the sound drive signal is supplied to the sound voice coil pattern 21.

Meanwhile, the external noise is input through the microphone 33, and is sent to the noise cancellation circuit 34. The noise cancellation circuit 34 inverts the phase of the noise signal from the microphone 33, and then, the drive current corresponding to the phase-inverted noise cancellation signal is supplied to the noise cancellation voice coil pattern 22.

Since the drive current corresponding to the sound signal and the drive current corresponding to the noise cancellation signal are supplied, electromagnetic force is generated by interaction between each type of drive current and the magnetic field of each magnet 13, and the diaphragm 11 vibrates in the thickness direction thereof. At this point, since not only the drive current corresponding to the sound signal but also the drive current corresponding to the noise cancellation signal are supplied, the diaphragm 11 vibrates based on a composite signal of the sound signal and the noise cancellation signal. Thus, sound of the sound signal can be output with the external noise being cancelled out.

As described above, in the present embodiment, the sound voice coil pattern 21 and the noise cancellation voice coil pattern 22 are formed on the flexible circuit board 20, and the drive current corresponding to the sound signal and the drive current corresponding to the noise cancellation signal are supplied. Thus, the diaphragm 11 vibrates based on the composite signal of the sound signal and the noise cancellation signal. Consequently, sound of the sound signal can be output with the external noise being cancelled out. As a result, reproduced sound with a favorable sound quality can be obtained without noise signal influence on the sound signal.

Moreover, in the present embodiment, the noise cancellation voice coil pattern 22 is, in addition to the sound voice coil pattern 21, formed on the flexible circuit board 20. Thus, the surface of the diaphragm 11 can be hardened by addition of the noise cancellation voice coil pattern 22. As a result, a transmission speed by the diaphragm 11 can be increased, and worsening of high-frequency characteristics can be avoided.

Next, a second embodiment of the present invention will be described.

FIG. 6 illustrates the second embodiment of the present invention. In the present embodiment, a noise cancellation voice coil pattern 22 is formed on each side of a sound voice coil pattern 21 formed on a flexible circuit board 20.

That is, the noise cancellation voice coil pattern 22 is formed on one side of the sound voice coil pattern 21 in the first embodiment. However, in the case of forming the noise cancellation voice coil pattern 22 on one side of the sound voice coil pattern 21, there is a probability that the amplitude of the diaphragm 11 is non-uniform.

For this reason, in the present embodiment, the noise cancellation voice coil pattern 22 is formed on each side of the sound voice coil pattern 21 so that the diaphragm 11 can uniformly vibrate on the sound voice coil pattern 21.

As in the first embodiment, the sound voice coil pattern 21 and the noise cancellation voice coil patterns 22 are, in the present embodiment, formed on the flexible circuit board 20, and drive current corresponding to a sound signal and drive current corresponding to a noise cancellation signal are supplied. Thus, the diaphragm 11 vibrates based on a composite signal of the sound signal and the noise cancellation signal. Consequently, sound of the sound signal can be output with external noise being cancelled out.

Moreover, the noise cancellation voice coil pattern 22 is formed on each side of the sound voice coil pattern 21 on the flexible circuit board 20. Thus, as compared to the first embodiment, the surface of the diaphragm 11 can be more hardened. As a result, a transmission speed by the diaphragm 11 can be increased, and worsening of high-frequency characteristics can be avoided.

Next, a third embodiment of the present invention will be described.

Figure 7:
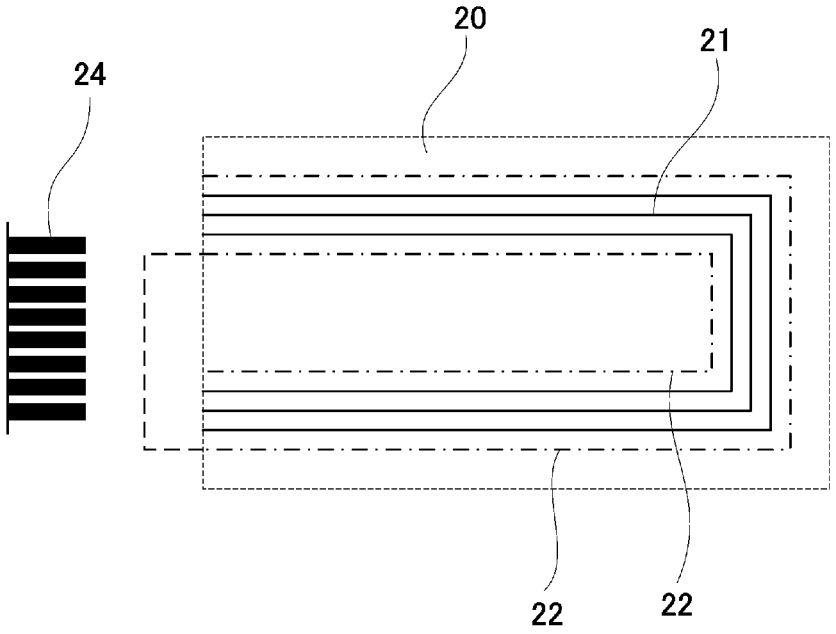
FIG. 7 is an enlarged partial view of a diaphragm, illustrating a third embodiment of the speaker device of the present invention.

FIG. 7 illustrates the third embodiment of the present invention. In general, as compared to a dynamic speaker device, a speaker device using a plane diaphragm 11 tends to exhibit a smaller impedance and consume greater current. This might lead to an increase in power consumption of a power amplifier circuit, and therefore, leads to functioning of an overcurrent protection circuit.

For this reason, in the present embodiment, a noise cancellation voice coil pattern 22 is formed on each side of a sound voice coil pattern 21 as in the second embodiment, and end portions of the noise cancellation voice coil patterns 22 are electrically connected together to form a single long noise cancellation voice coil pattern 22 disposed on both sides of the sound voice coil pattern 21.

With this noise cancellation voice coil pattern 22 having a great length dimension, the resistance of the noise cancellation voice coil pattern 22 increases, and therefore, the impedance of the noise cancellation voice coil pattern 22 can be enhanced.

As in each of the above-described embodiments, the sound voice coil pattern 21 and the noise cancellation voice coil pattern 22 are, in the present embodiment, formed on a flexible circuit board 20, and drive current corresponding to a sound signal and a noise cancellation signal is supplied. Thus, the diaphragm 11 vibrates based on a composite signal of the sound signal and the noise cancellation signal. Consequently, sound of the sound signal can be output with external noise being cancelled out.

Moreover, the sound voice coil pattern 21 and the noise cancellation voice coil pattern 22 are formed on the flexible circuit board 20. Thus, the surface of the diaphragm 11 can be hardened. As a result, a transmission speed by the diaphragm 11 can be increased, and worsening of high-frequency characteristics can be avoided.

Further, the end portions of the noise cancellation voice coil patterns 22 are electrically connected together, and the noise cancellation voice coil pattern 22 is formed to have a great length dimension. Thus, the resistance of the noise cancellation voice coil pattern 22 increases, and therefore, the impedance of the noise cancellation voice coil pattern 22 can be enhanced. As a result, current consumption can be reduced. This can prevent functioning of the overcurrent protection circuit.

Note that in the first and second embodiments, drawing of a wiring pattern of the noise cancellation voice coil pattern 22 can be devised such that a great length dimension of the noise cancellation voice coil pattern 22 is ensured. Thus, the impedance of the noise cancellation voice coil pattern 22 can be increased. However, in the present embodiment, the impedance of the noise cancellation voice coil pattern 22 can be easily increased without such devising of drawing of the wiring pattern.

Next, a fourth embodiment of the present invention will be described.

Figure 8:
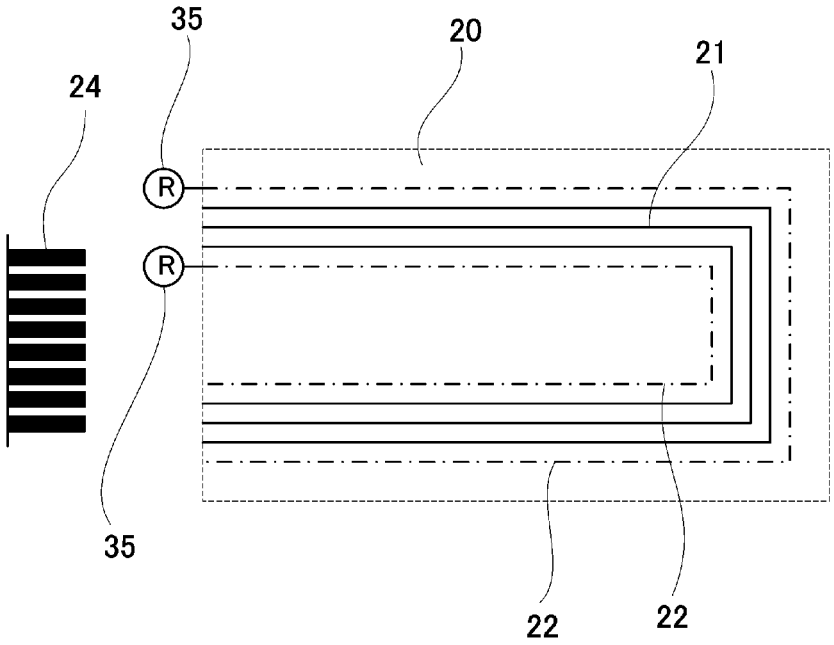
FIG. 8 is an enlarged partial view of a diaphragm, illustrating a fourth embodiment of the speaker device of the present invention.

FIG. 8 illustrates the fourth embodiment of the present invention. In order to increase the impedance of a noise cancellation voice coil pattern 22, the noise cancellation voice coil pattern 22 is, in the present embodiment, formed on each side of a sound voice coil pattern 21, and a resistor element 35 is connected to a middle portion of each noise cancellation voice coil pattern 22.

With the resistor element 35 connected to each noise cancellation voice coil pattern 22, the resistance of the noise cancellation voice coil pattern 22 is increased, and therefore, the impedance of the noise cancellation voice coil pattern 22 can be enhanced.

As in each of the above-described embodiments, the sound voice coil pattern 21 and the noise cancellation voice coil patterns 22 are, in the present embodiment, formed on a flexible circuit board 20, and drive current corresponding to a sound signal and a noise cancellation signal is supplied. Thus, a diaphragm 11 vibrates corresponding to a composite signal of the sound signal and the noise cancellation signal. Consequently, sound of the sound signal can be output with external noise being cancelled out.

Moreover, the sound voice coil pattern 21 and the noise cancellation voice coil patterns 22 are formed on the flexible circuit board 20. Thus, the surface of the diaphragm 11 can be hardened. As a result, a transmission speed by the diaphragm 11 can be increased, and worsening of high-frequency characteristics can be avoided.

Further, since the resistor element 35 is connected to the middle portion of each noise cancellation voice coil pattern 22, the resistance of the noise cancellation voice coil pattern 22 can be increased by the resistor element 35. Thus, the impedance of the noise cancellation voice coil pattern 22 can be enhanced. As a result, current consumption can be reduced. This can prevent functioning of an overcurrent protection circuit.

Next, a fifth embodiment of the present invention will be described.

FIG. 9 illustrates the fifth embodiment of the present invention. In the present embodiment, a reinforcement pattern 36 is formed between two adjacent patterns of a sound voice coil pattern 21 and/or a noise cancellation voice coil pattern 22 on a flexible circuit board 20.

The reinforcement pattern 36 is a pattern formed of metal foil such as copper foil or foil of a hard material, for example. The flexible circuit board 20 is reinforced by the reinforcement patterns 36, and therefore, a transmission speed by a diaphragm 11 is increased.

As in each of the above-described embodiments, the sound voice coil pattern 21 and the noise cancellation voice coil pattern 22 are, in the present embodiment, formed on the flexible circuit board 20, and therefore, sound of a sound signal can be output with external noise being cancelled out.

Moreover, the sound voice coil pattern 21 and the noise cancellation voice coil pattern 22 are formed on the flexible circuit board 20, and the reinforcement pattern 36 is formed between two adjacent patterns of the sound voice coil pattern 21 and/or the noise cancellation voice coil pattern 22. Thus, the surface of the diaphragm 11 can be more hardened. As a result, the transmission speed by the diaphragm 11 can be increased, and high-frequency characteristics can be significantly improved.

Note that aspects of the present invention have been described in the above-described embodiments, and the present invention is not limited to these embodiments.

For example, in each of the above-described embodiments, the case where the single or double noise cancellation voice coil patterns 22 are formed has been described. However, three or more noise cancellation voice coil patterns 22 may be formed.

Moreover, in each of the above-described embodiments, the sound voice coil pattern 21 and the noise cancellation voice coil pattern(s) 22 are formed on one side of the flexible circuit board 20, but may be formed on both sides of the flexible circuit board 20, for example.

For example, the sound voice coil pattern 21 may be formed on the flexible circuit board 20, and an insulating layer may be formed to cover the sound voice coil pattern 21. Then, the noise cancellation voice coil pattern(s) 22 may be formed on the surface of the insulating layer. With this configuration, the sound voice coil pattern 21 and the noise cancellation voice coil pattern(s) 22 may be formed on top of one another.

Further, in each of the above-described embodiments, the example where the N-pole and the S-pole of each magnet 13 are formed in the striped pattern and the sound voice coil pattern 21 and the noise cancellation voice coil pattern 22 are arranged meandering has been described. However, the magnetized state of the N-pole and the S-pole of each magnet 13 can be changed such that the sound voice coil pattern 21 and the noise cancellation voice coil pattern 22 are arranged according to the magnetized state of each magnet 13.

REFERENCE SIGNS LIST

10 speaker device
11 diaphragm
12 buffer member
13 magnet
14 holding member
20 flexible circuit board
21 sound voice coil pattern
22 noise cancellation voice coil pattern
23 conductive wire drawing portion
24 terminal portion
25, 26 through-hole
30 drive circuit
31 digital sound source
32 sound driver circuit
33 microphone
34 noise cancellation circuit
35 resistor element
36 reinforcement pattern

The invention claimed is:

1. A speaker device comprising:

a plane diaphragm including a flexible circuit board, a sound voice coil, a first noise cancellation voice coil, and a second noise cancellation voice coil, wherein a drive current corresponding to a sound signal is supplied to the sound voice coil, a drive current corresponding to a noise cancellation signal is supplied to the first noise cancellation voice coil and the second noise cancellation voice coil, the sound voice coil, the first noise cancellation voice coil, and the second noise cancellation voice coil are formed in a pattern with correspond to magnetic field formed by a magnet, the sound voice coil is formed in a meander pattern across the flexible circuit board, the first noise cancellation voice coil and the second noise cancellation voice coil are formed along the sound voice coil, the first noise cancellation voice coil is disposed on one side of the sound voice coil, and the second noise cancellation voice coil is disposed on another side of the sound voice coil.

2. The speaker device according to claim 1, wherein end portions of the first noise cancellation voice coil, and the second noise cancellation voice coil are electrically connected together to form a single noise cancellation voice coil pattern.

3. The speaker device according to claim 1, wherein a resistor element is connected to a middle portion of the first noise cancellation voice coil, and the second noise cancellation voice coil.

4. The speaker device according to claim 1, wherein a reinforcement element is formed in at least one of an area between the sound voice coil and the first noise cancellation voice coil and an area between the sound voice coil and the second noise cancellation voice coil.

* * * * *